US005935471A

United States Patent [19]

St. Louis

[11] Patent Number: 5,935,471

[45] Date of Patent: Aug. 10, 1999

[54] HEATER COIL SUPPORT AND MOUNTING BRACKET

[75] Inventor: Robert St. Louis, St. Leonard, Canada

[73] Assignee: Camco Inc., Mississauga

[21] Appl. No.: 09/052,121

[22] Filed: Mar. 31, 1998

[51] Int. Cl.[6] ..... H05B 3/68; H05B 3/06; H01B 17/00

[52] U.S. Cl. ..... 219/465.1; 219/532; 174/138 J

[58] Field of Search ..... 174/138 J, 167; 219/532, 536, 542, 460.1, 461.1, 467.1, 465.1; 338/280, 281, 282, 317, 318

[56] References Cited

U.S. PATENT DOCUMENTS

| | | | |
|---|---|---|---|
| 3,154,281 | 10/1964 | Frank | 174/138 J |
| 3,846,619 | 11/1974 | Wightman et al. | 219/532 |
| 3,920,887 | 11/1975 | Kloos et al. | 174/148 |
| 3,935,376 | 1/1976 | Cooper et al. | 174/138 J |
| 3,952,409 | 4/1976 | Allison et al. | 219/532 |
| 3,992,609 | 11/1976 | Alexander | 219/532 |
| 4,250,399 | 2/1981 | King | 219/532 |
| 4,392,052 | 7/1983 | Magnusson et al. | 219/532 |
| 4,656,340 | 4/1987 | St. Louis | 219/532 |
| 4,848,567 | 7/1989 | Howard et al. | 206/332 |
| 5,122,640 | 6/1992 | Holmes | 219/532 |
| 5,124,534 | 6/1992 | Williams et al. | 174/138 J |
| 5,578,232 | 11/1996 | Engelke | 219/532 |

FOREIGN PATENT DOCUMENTS

| | | | |
|---|---|---|---|
| 771787 | 11/1967 | Canada | 309/106 |

*Primary Examiner*—Teresa Walberg
*Assistant Examiner*—Sam Paik

[57] ABSTRACT

A ceramic heater coil support bracket, suitable for use in a clothes dryer, supports a helically wound heating coil in spaced apart relation from a support surface or wall. The bracket includes a base adapted for securement to the support surface and a pair of spaced apart arms upstanding from the base defining an open slot extending across the bracket in a transverse direction above the base. Each of the arms includes a coil support post having an arrowhead shape extending inwardly toward of the slot. Each of the posts includes inner and outer coil receiving grooves adapted to receive consecutive turns of the coil. The posts are laterally offset from each other in the transverse direction of the slot so that the posts support different consecutive turns of the coil. The posts have a relatively flat upper surface having an arrowhead shape projecting into the slot with sloping inside and outside surfaces of the arrowhead tapering outwardly and downwardly from the top surface. The arrowhead has two barbs each defining one wall of the grooves. The inner and outer receiving grooves of each of the posts are spaced apart in the direction of coil pitch a distance slightly larger than one coil pitch. The inner receiving grooves of each of the coil slots are spaced apart a distance slightly less than ½ the pitch of the coil. There is also disclosed an arrangement for mounting the bracket in the supporting wall in which the supporting wall includes a slot having widened and narrowed ends that co-operate with the bracket to hold the bracket in the slot.

14 Claims, 4 Drawing Sheets

HEATER COIL SUPPORT AND MOUNTING BRACKET

FIELD OF THE INVENTION

This invention relates to a heater coil mounting support bracket for a clothes dryer or the like. More particularly, it relates to an insulating ceramic bracket for securing a heater coil within a clothes dryer.

BACKGROUND OF THE INVENTION

Various types of mounting brackets have been constructed in the past to support heater coils within an electric heater for clothes dryer. In such brackets, the heater coils pass through ceramic grommets or other types of insulating bushings retained in brackets and then the brackets are mounted on a retaining wall. Such brackets attempt to provide a simple, efficient and cost effective way of securing the insulating bushings and for mounting the coils to the retaining wall.

It should be appreciated that to be cost efficient, the mounting bracket should be simple to construct and should be capable of being quickly secured and released without special tools. In this respect, attempts in the prior art to provide such a mounting bracket met with varying degrees of success.

For example, Canadian patent No. 771,787 of Kinney issued Nov. 14, 1967 describes a mounting assembly to be inserted into a pipe encasement. The assembly includes special ceramic insulators having a dove-tail base that is retained in a mounting strip and secured by means of jaws or clips that are then spot welded onto the mounting strip. This mounting assembly requires a special ceramic insulator and several interacting pieces as well as a welding step during installation.

U.S. Pat. No. 3,935,376 issued Jan. 27, 1976 to Cooper et al discloses a one piece ceramic insulator for supporting a ribbon type heating element. The ceramic insulator includes a slot located in a side surface of the insulator and includes a flat bearing surface over which the ribbon heating element is supported.

U.S. Pat. No. 4,250,399 issued Feb. 10, 1981 to Reynold King discloses an open coil electric heater having a rigid frame carrying ceramic coil supports which are detectors connected to the frame. Each coil support has an end formed with a cross slot to pass a part of the coil convolution or turn into the slot to be received in a groove. The coil is readily detachable and is inserted into the slot by twisting the coil at an angle of about 90 degrees relative to its normal direction of travel. The insulator supports only one-half of a convolution of the coil and requires considerable twisting by an operator to insert the coil into the ceramic insulator.

U.S. Pat. No. 4,848,567 issued Jul. 18, 1989 to Keith Howard et al teaches the use of an insulator having L-shaped brackets that receive different non-consecutive convolutions or turns of a coiled heating element.

U.S. Pat. No. 5,578,232 issued Nov. 26, 1996 to Roger Engelke discloses an open coil heater assembly comprising two parts which are secured relative to each other to squeeze between opposing hook shaped flanges the heating coil.

There is a need for a ceramic insulator which permits for easy assembly of a helically wound heating coil which can be assembled by an operator simply pushing the coil down onto the insulator without having the operator twist or bend the heating coil during the assembly process.

SUMMARY OF THE INVENTION

The present invention provides for an improved heating coil mounting support bracket suitable for use in a clothes dryer which uses a ceramic insulator mounted to the dryer and formed with two upstanding side walls with an open slot therebetween. Each side wall includes a post extending into the slot with inner and outer receiving grooves adapted to receive consecutive turns of the heater coil. The spacing between the inner and outer grooves is preferably slightly larger than the pitch of one consecutive turn of the heater coil. This holds the heater coil relative to each post. Further, the distance between the inner receiving grooves of each of the posts is preferably less than one-half the pitch of the heater coil such that the heater coil is twisted slightly during insertion downwardly over the posts and the coil springs back into inner receiving grooves and is held firmly in place by its own resiliency.

It is therefore an object of one aspect of this invention to provide a support bracket for a heating coil mounting support bracket which is relatively simple and economical to construct.

It is the object of another aspect of the invention to provide a support bracket for a heating coil made from a ceramic material of unitary construction.

In accordance with an aspect of the present invention there is provided a heating coil mounting support bracket for supporting a helically wound heating coil in spaced apart relation from a support surface. The bracket is a unitary substrate of electrically and heat insulating material comprising a base adapted for securement to the support surface and a pair of spaced apart arms upstanding from the base defining an open slot extending across the bracket in a transverse direction above the base. Each of the arms includes a coil support post extending inwardly toward the slot. Each of the posts includes inner and outer coil receiving grooves adapted to receive consecutive turns of the coil. The posts are laterally offset from each other the transverse direction of the slot so that the posts support different consecutive turns of the coil. The present invention provides the advantage of a single or unitary insulator adapted to hold at least two independent consecutive turns of the heater coil and which allows for the consecutive turns of the heater coil to be readily placed or secured relative to the bracket simply by pushing the heater coil down onto the bracket.

Each arm may include a curved inside surface portion laterally adjacent the post and spaced across from the post on the spaced apart arm. Preferably the posts have a relatively flat upper surface having an arrowhead shape projecting into the slot with sloping inside and outside surfaces of the arrowhead tapering outwardly and downwardly from the top surface. The arrowhead has two barbs each defining one wall of the grooves. By providing an arrowhead shape with tapering side walls, the heater coil may be pushed over the arrowhead surfaces causing the coil to twist and deform slightly and spring back into a shape more consistent with its natural pitch when the coils spring back into the receiving grooves of posts. Preferably, the outer wall of the groove is defined where the post meets the arm. The outside surface of the arrowhead preferably has a greater slope and longer surface along the top surface of the post than the inside surface of the arrowhead.

Preferably the sloping inside surface of the arrowhead shaped post partially extends downwardly toward the open slot. The inside surface has a flat undercut surface adapted to allow the heater coil to clear the posts when inserted onto the bracket and hook onto the flat undercut surface after clearing the post. Preferably, the inside surface extends down about 40 degrees toward the open slot.

In accordance with another aspect of the present invention there is provided an arrangement for mounting the bracket of the present invention in a supporting wall. In particular, the supporting wall includes upper and lower surfaces and an elongate slot passing therethrough. The slot has an intermediate widened portion, a first narrowed end extending away from a first end of the widened portion, and a second narrowed end extending away from a second end of the widened portion opposite to the first end. The first narrowed end including a tab member lanced in the flat supporting wall. The first narrowed end extends further away from the widened portion than the second end. The arrangement includes a one-piece ceramic bracket adapted to carry the heating coil on an upper portion thereof. The upper portion of the bracket has a width greater than that of the widened portion of the elongate slot so as to engage the upper surface of the supporting wall adjacent the elongate slot. The bracket includes a base portion having a width less than that of the widened portion of the elongate slot and a length greater than that of the widened portion of the elongate slot such that the base portion is adapted to engage the lower surface of the supporting wall adjacent the first and second narrowed ends of the elongate slot. The base portion has a first end passing through the widened slot towards and movable along the first narrowed end over the tab member to permit a second end of the base member to be inserted through the widened portion. The bracket is then movable toward the second narrowed end and the tab member is depressed against the first end of the base portion to lock the bracket in the slot.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
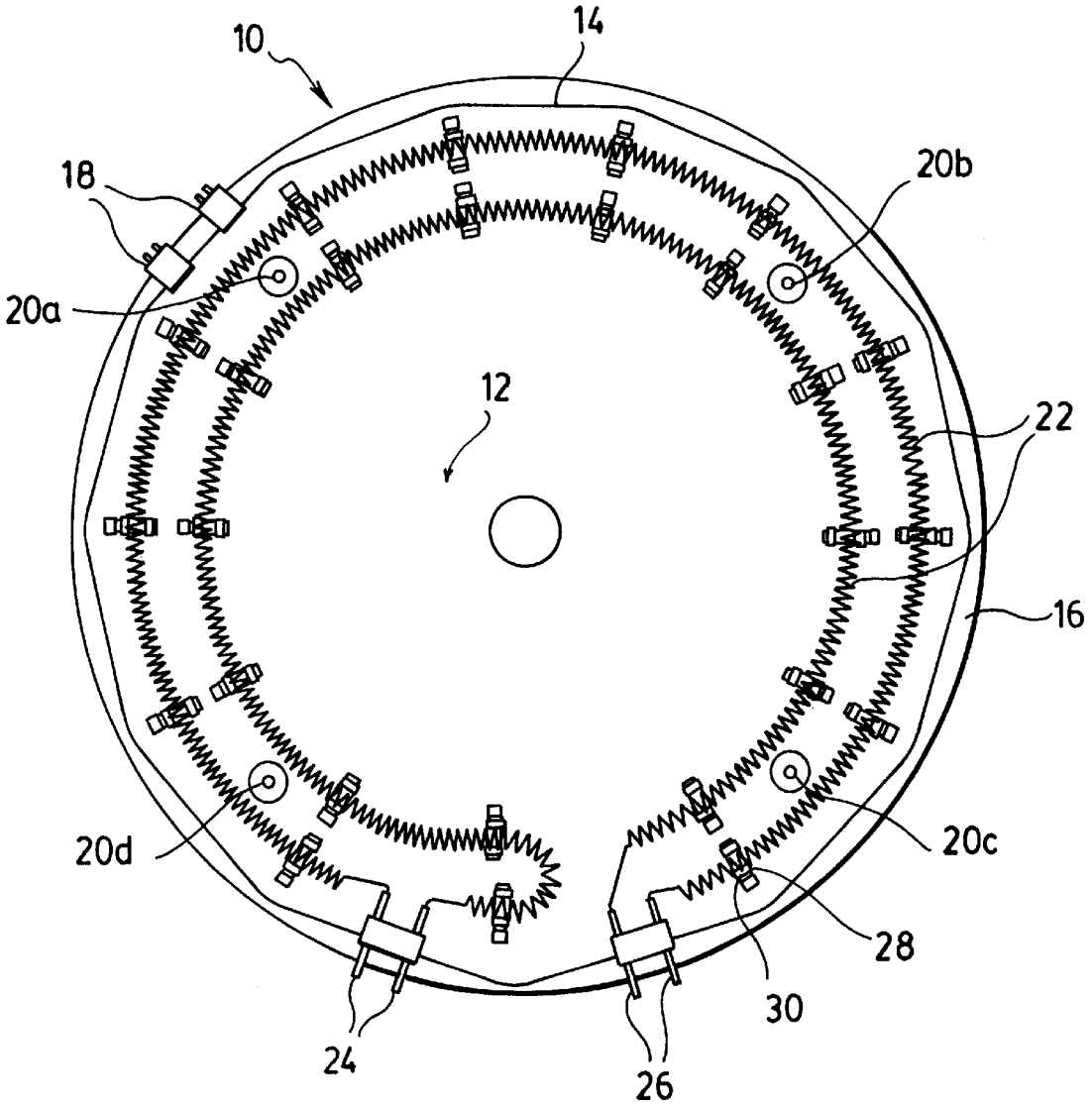
FIG. 1 is an elevation view showing the positioning of heating elements around the perimeter of a dryer support wall and held in place by the heating coil mounting support bracket of the present invention.
Figure 2:
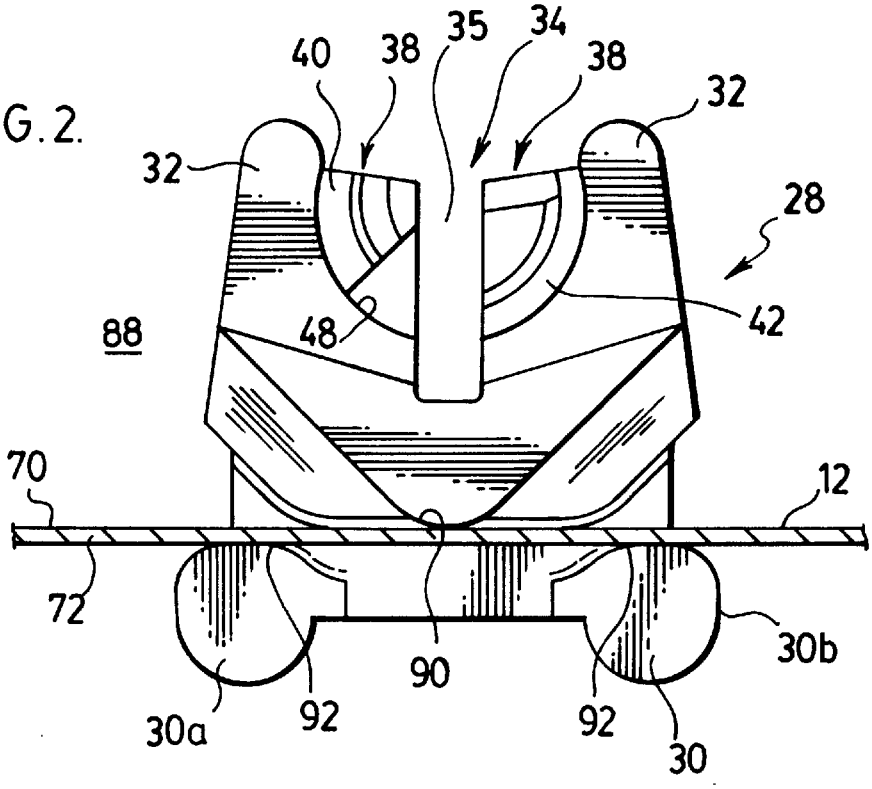
FIG. 2 is a front elevation view of a heater coil mounting support bracket of the present invention mounted on a support wall.

In FIG. 1, a cylindrical type heater such as used in a clothes dryer is shown generally at 10. The heater has a support wall 12 with a peripheral wall 16 and a rim 14 extending around its edges. Wall 16 includes openings for securing thermostats 18 to the heater assembly. In the embodiment shown in FIG. 1 four securing bolts 20*a,b,c* and *d* respectively, are shown for further retaining the heater assembly in place relative to the dryer. Two helically wound heater coils 22 extends around the parameter of support wall 12. One end of the coils is connected to a power source via terminals 24, and the other end is connected to terminals 26. Heater coils 22 are retained in position by a series of heater coil mounting support brackets 28 that are secured to the support wall 12 in a manner shown generally in FIG. 2.

The bracket 28 comprises a unitary ceramic substrate of electrically insulating material. The bracket 28 includes a base 30 secured to the support wall 12.

The bracket 28 includes spaced apart arms 32 upstanding from the base 30 defining an open slot 34 extending across the bracket 28 in a transverse direction 36 above the base 30. The slot 34 includes a deepened U-shaped slot 35 extending below the arms 32 and laterally across the bracket to facilitate increased air flow across the heater coils 22 as a result of forced air convection currents in the dryer. This results in better cooling of the bracket and the heater coil 22.

Figure 6:
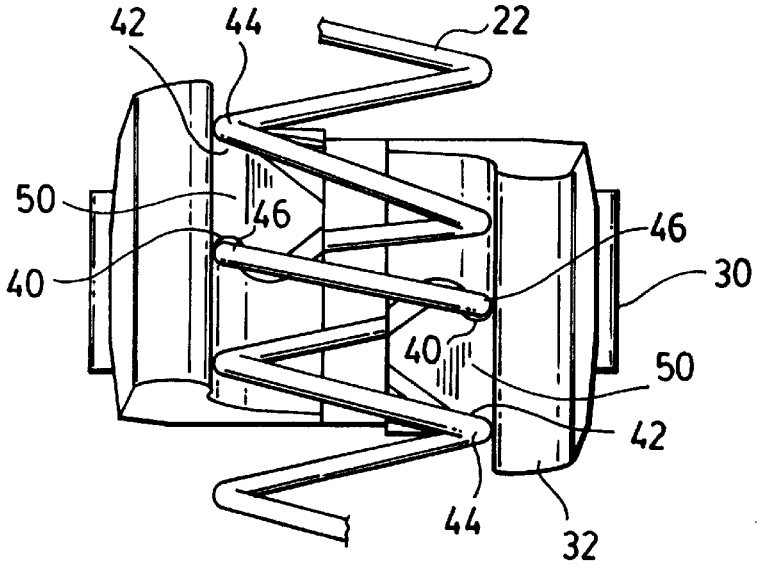
FIG. 6 is a view similar to FIG. 3 and shows the placement of the coil in the heating coil mounting bracket of the present invention.

Each of the opposing arms 32 includes a coil support post 38 extending inwardly toward the slot 35. Each of the posts 38 includes inner coil receiving grooves 40 and outer coil receiving grooves 42 adapted to receive consecutive turns 44, 46 (as shown in FIG. 6) of the coil 22. The posts are laterally offset from each other in the transverse direction 36 of the slot 34 so that the posts 38 support different consecutive turns 44, 46 of the coil 22. The inner and outer receiving grooves 40, 42 of the posts 38 are preferably spaced apart in the direction of coil pitch a distance slightly larger than one coil pitch. This results in the spacing of the stem 43 located between the inner groove 40 and outer groove 42 of the post 38 to be thicker than one coil turn. It should be understood that by allowing a thicker stem portion 43 in the post 38 sandwiched between consecutive turns of the heater coil 22, the ability of the ceramic substrate to withstand heating by the coils is optimized. The inner receiving grooves 40 of each of the posts 38 are preferably spaced apart a distance slightly less than ½ the pitch of the coil.

Each of the posts 38 has a relatively flat upper surface 50. Surface 50 has an arrowhead shape projecting toward the slot 35. The posts 38 extend towards the slot 35 a distance less than half the distance across the slot 34 between the arms 32.

The arrowhead shape of the posts 38 have sloping inside surfaces 52 and sloping outside surfaces 54 that respectively taper at 56 and 58 outwardly and downwardly from the top surface 50. The arrowhead posts 38 each have two barbs 60, 62 each defining one wall of respective grooves 40, 42. The other wall of grooves 40, 42 is defined where the post 38 meets the arm 32.

Figure 3:
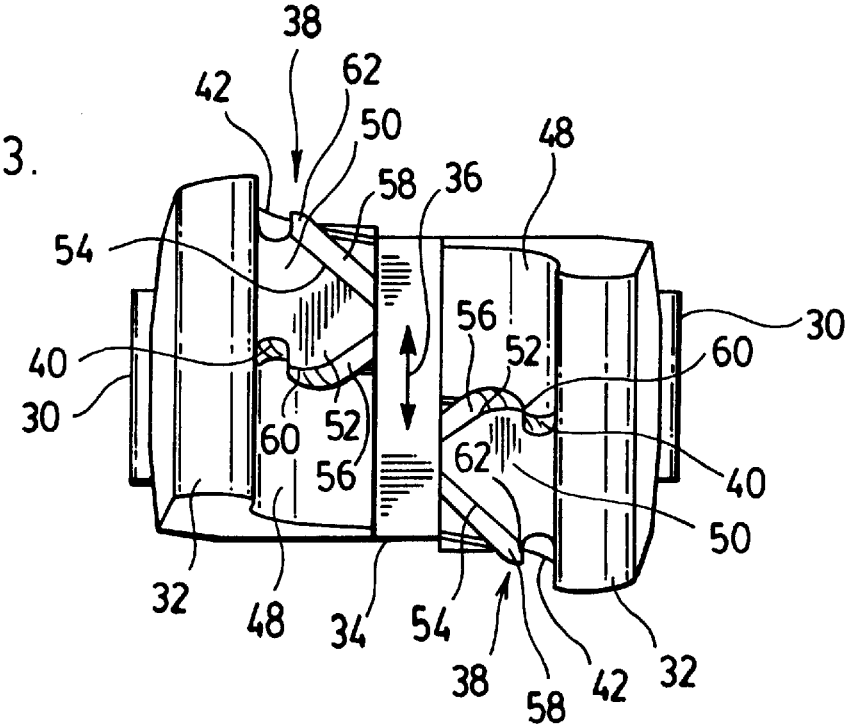
FIG. 3 is a plan view of the heater coil mounting support bracket.

Referring to FIG. 3 the outside surface 54 of the arrowhead posts 38 has a greater slope and longer surface along the top surface 50 than that of inside surface 52.

Each arm 32 further has a curved inside surface portion 48 laterally adjacent the post 38 and spaced across from the post 38 on the spaced apart arm 32.

Figure 4:
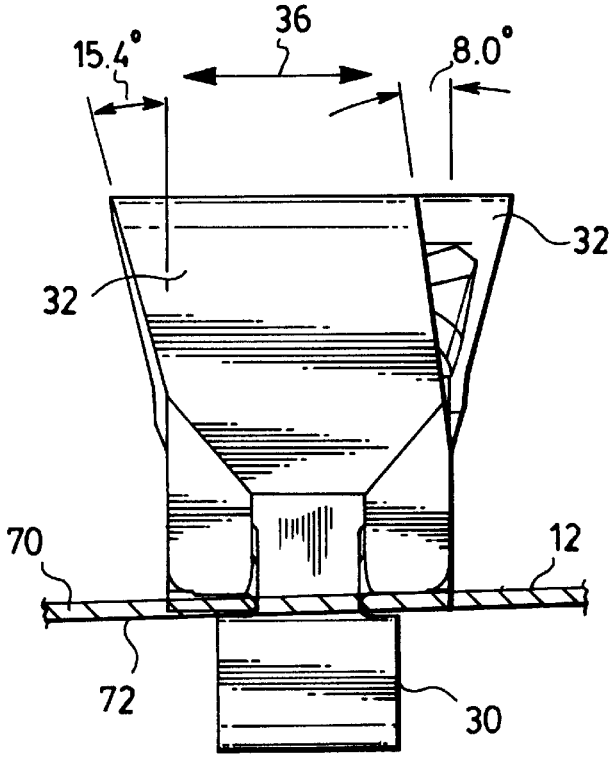
FIG. 4 is an end view the heater coil mounting support bracket.

As best seen in FIG. 4, each of the arms 32 in the transverse direction 36 slopes away from the curved portion 48 and towards the arrowhead post 38.

Figure 5:
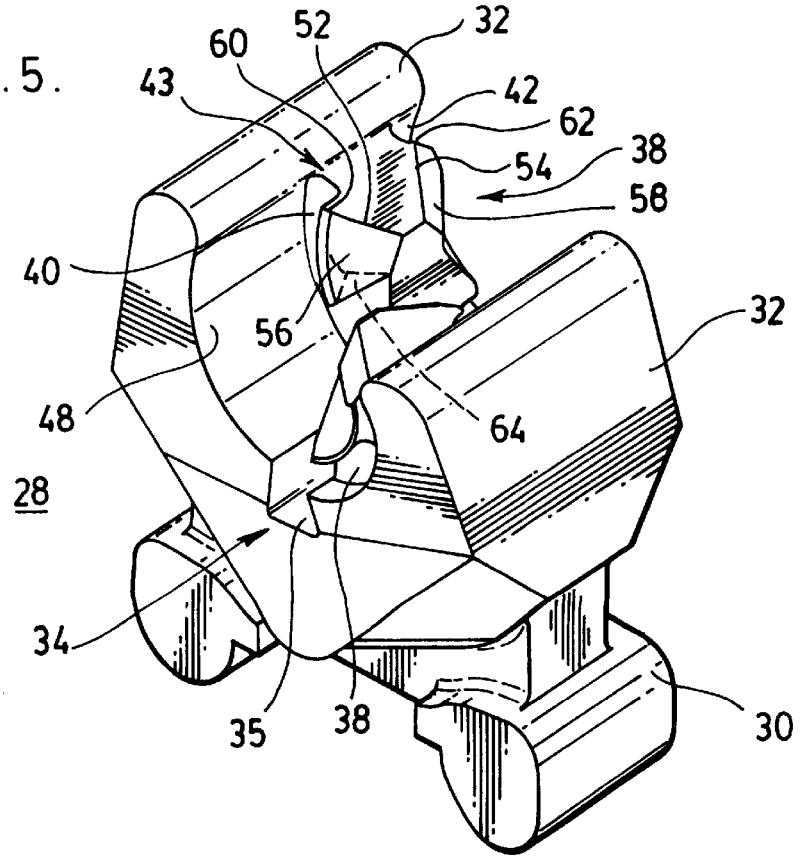
FIG. 5 is a front isometric view of the heater coil mounting support bracket.

As best seen in FIG. 5, the taper 56 of the inside surface 52 of barb 60 does not extend all the way down of the U-shaped slot 35. This barb 60 extends down about 40 degrees and is undercut back to the stem 43. The undercut surface is squared off and is a flat undercut surface as shown by dotted line 64. The purpose of the undercut surface 64 on each inside barb 60 of posts 38 allows the heater coil 22 clearance when inserted onto the bracket 28. As indicated above, the coil 22 twists by itself as it is forced down on the posts 38 over barbs 60 and 62. In particular, the coil twists as it passes over the inner barbs 60, is allowed to clear the barbs 60 due to the recessed undercut flat surface 64, and springs back under the barb 60 being held in place by its own resiliency against the undercut flat surface 64 of each barb.

Figure 7:
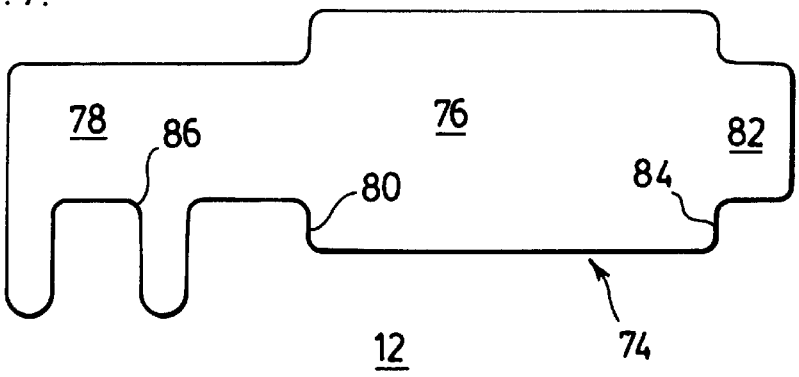
FIG. 7 is a plan view of the retaining aperture of the present invention positioned in the support surface or support wall into which the heater coil mounting bracket is inserted; and, FIG. 8 is a plan view showing the arrangement of the heater coil mounting bracket in the slot of the supporting wall.
Figure 8:
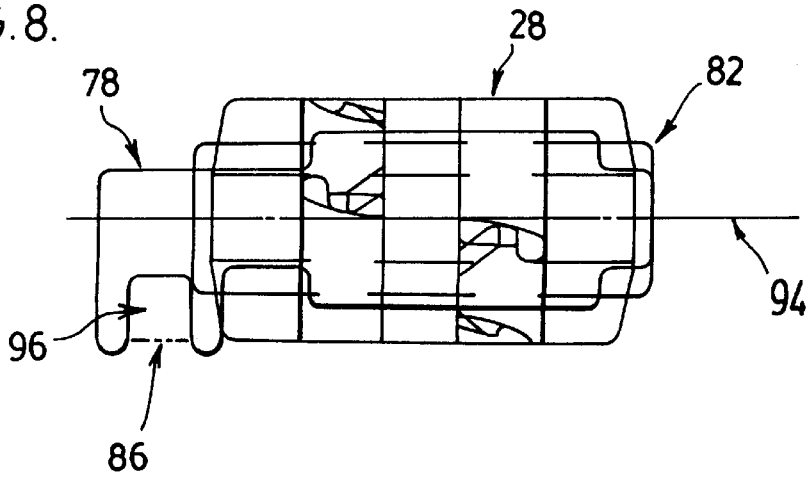

In accordance with another aspect of the present invention, reference is made to FIGS. 7 and 8 to describe the arrangement for mounting a heating coil 22 relative to a flat supporting wall 12.

The flat supporting wall 12 has upper and lower surfaces 70, 72 and an elongate slot 74 passing therethrough. The slot 74 has an intermediate widened portion 76, a first narrowed end 78 extending away from a first end 80 of the widened portion 76, and a second narrowed end 82 extending away from a second end 84 of the widened portion 76 opposite to the first end. The first narrowed end 78 includes a tab member 86 lanced in the flat supporting wall 12. The first narrower end 78 extends further away from the widened portion 76 than the second end 82.

The one-piece ceramic bracket 28 is adapted to carry the heating coil 22 on an upper portion 88 thereof as described hereinabove. The upper portion 88 has a width greater than that of the widened portion 76 of the elongate slot 74 so as to engage the upper surface 70 of the supporting wall 12 adjacent the elongate slot 74. The bracket 28 includes a base portion 30 having a width less than that of the widened portion 76 of the elongate slot 74. The base portion 30 has a length greater than that of the widened portion 76 of the elongate slot 74 such that the base portion 30 is adapted to engage the lower surface 72 of the supporting wall 12 adjacent the first and second narrowed ends 78, 82 of the elongate slot 74. The base portion 30 has a first end 30*a* passing through the widened slot 76 towards and movable along the longitudinal axis 94 of the slot 74 towards the first narrowed end 78 and over the tab member 86 to permit a second end 30*b* of the base member 30 to be inserted through the widened portion 76. The bracket 28 is then movable toward the second narrowed end 82 which limits movement of the bracket in this opposite direction along longitudinal axis 94. The tab member 86 is then depressed, as indicated by bend 96, against the first end 30*a* of the of the base portion 30 to lock the bracket 28 in the slot 74 against the second narrowed end.

Respective surfaces 90, 92 (FIG. 2) of the upper portion and base portion of the bracket are curved to facilitate engagement with respective upper and lower surfaces 70, 72 of the supporting wall 12.

Certain preferred embodiments of the invention have been described in detail. From a reading of this disclosure, obvious modifications will be evident to those skilled in the art without departing from the spirit of the invention disclosed or from the scope of the appended claims.

What I claim is:

1. A heating coil mounting support bracket for supporting a helically wound heating coil in spaced apart relation from a support surface, said bracket comprising a unitary substrate of electrically and heat insulating material comprising:

a base adapted for securement to the support surface;

a pair of spaced apart arms upstanding from said base defining an open slot extending across said bracket in a transverse direction above the base, each of said arms including a coil support post extending inwardly toward said slot, each of said posts including inner and outer coil receiving grooves adapted to receive consecutive turns of said coil, said posts being laterally offset from each other the transverse direction of said slot so that said posts support different consecutive turns of said coil.

2. The heating coil mounting support bracket of claim 1 wherein each arm includes a curved inside surface portion laterally adjacent the post and spaced across from the post on the spaced apart arm.

3. The heating coil mounting support bracket of claim 2 wherein the posts have a relatively flat upper surface having an arrowhead shape projecting into the slot with sloping inside and outside surfaces of the arrowhead tapering outwardly and downwardly from the top surface, the arrowhead having two barbs each defining one wall of the grooves.

4. The heating coil mounting support bracket of claim 3 wherein other wall of the groove is defined where the post meets the arm.

5. The heating coil mounting support bracket of claim 4 wherein the outside surface of the arrowhead has a greater slope and longer surface along the top surface of the post than the inside surface of the arrowhead.

6. The heating coil mounting support bracket of claim 2 wherein each of said arms upstanding from said base slopes in the transverse direction away from the curved portion and towards the post.

7. The heating coil mounting support bracket of claim 1 wherein the inner and outer receiving grooves of each of said posts are spaced apart in the direction of coil pitch a distance slightly larger than one coil pitch.

8. The heating coil mounting support bracket of claim 7 wherein the inner receiving grooves of each of said coil slots are spaced apart a distance slightly less than ½ the pitch of the coil.

9. The heating coil mounting support bracket of claim 1 wherein each of said posts extends into the slot a distance less than half the distance across the slot between the arms.

10. The heating coil mounting support bracket of claim 1 wherein the open slot includes a deepened U-shaped slot extending below the arms and laterally across the bracket to facilitate increased air flow across the heater coils.

11. The heating coil mounting support bracket of claim 3 wherein the sloping inside surface of the arrowhead shaped post partially extends downwardly toward the open slot, the inside surface having a flat undercut surface adapted to allow the heater coil to slide on the posts when inserted onto the bracket and hook onto the flat undercut surface after clearing the post.

12. The heating coil mounting support bracket of claim 11 wherein the inside surface extends down about 40 degrees toward the open slot.

13. An arrangement for mounting a heating coil relative to a flat supporting wall, wherein:

the flat supporting wall has upper and lower surfaces and an elongate slot passing therethrough, the slot having an intermediate widened portion, a first narrowed end extending away from a first end of the widened portion, and a second narrowed end extending away from a second end of the widened portion opposite to the first end, and the first narrowed end including a tab member lanced in the flat supporting wall and the first narrowed end extending further away from the widened portion than the second end; and, a one-piece ceramic bracket adapted to carry the heating coil on an upper portion thereof, the upper portion of the bracket having a width greater than that of the widened portion of the elongate slot so as to engage the upper surface of the supporting wall adjacent the elongate slot, the bracket including a base portion having a width less than that of the widened portion of the elongate slot and a length greater than that of the widened portion of the elongate slot such that the base portion is adapted to engage the lower surface of the supporting wall adjacent the first and second narrowed ends of the elongate slot, the base portion having a first end passing through the widened slot towards and movable along the first narrowed end over the tab member to permit a second end of the base member to be inserted through the widened portion, the bracket then being movable toward the second narrowed end and the tab member being depressed against the first end of the base portion to lock the bracket in the slot.

14. The arrangement for mounting a heating coil relative to a flat supporting wall as claimed in claim 13 wherein the surfaces of the upper portion of the bracket and the base portion of the bracket are curved to facilitate engagement with respective upper and lower surfaces of the supporting wall.

* * * * *